United States Patent [19]

Kozak

[11] 4,184,926

[45] Jan. 22, 1980

[54] ANTI-CORROSIVE COATING ON MAGNESIUM AND ITS ALLOYS

[76] Inventor: Otto Kozak, 27 W. Beech St., Long Beach, N.Y. 11561

[21] Appl. No.: 4,278

[22] Filed: Jan. 17, 1979

[51] Int. Cl.[2] ..... C25D 11/30

[52] U.S. Cl. ..... 204/32 R; 204/56 R

[58] Field of Search ..... 204/32 R, 38 A, 56 M

[56] References Cited

U.S. PATENT DOCUMENTS

| | | | |
|---|---|---|---|
| 1,574,289 | 2/1926 | Keeler | 204/56 M |
| 2,313,754 | 3/1943 | Loose | 204/56 M |
| 3,832,293 | 8/1974 | Hradcovsky et al. | 204/56 M |
| 3,834,999 | 9/1974 | Hradcovsky et al. | 204/56 M |

*Primary Examiner*—R. L. Andrews

*Attorney, Agent, or Firm*—Michael Ebert

[57] ABSTRACT

To produce a corrosion-resistant coating thereon which is hard and uniform and capable of withstanding the action of strong acids and alkalis, a body of magnesium metal or an alloy of magnesium is first treated with an aqueous solution of hydrofluoric acid to form a fluoromagnesium layer on the metal surface. The coated metal is then immersed in an electrolyte bath comprising an aqueous solution of alkali metal silicate, and an aqueous solution of an alkali metal hydroxide. An electrical potential is applied between the magnesium metal anode and a cathode (iron or nickel) in the bath until a visible spark is discharged on the surface of the metal. The potential difference is maintained for a few minutes until a uniform silicate layer is formed on the fluoromagnesium layer.

32 Claims, No Drawings

ANTI-CORROSIVE COATING ON MAGNESIUM AND ITS ALLOYS

BACKGROUND OF INVENTION

1. Field of Invention

This invention relates to a method of forming an anti-corrosive film on magnesium metal and its alloys which is smooth, adherent and durable, and to the product resulting therefrom. In particular, the invention relates to a method comprising pretreatment of such metals with a solution of hydrofluoric acid to form a fluoromagnesium film on the metal, followed by electrolytic coating in an aqueous solution comprising an alkali metal silicate (or other suitable salts) and an alkali metal hydroxide.

2. The Prior Art

The protection of metallic surfaces, including magnesium and its alloys, against corrosion and chemical attack has heretofore received considerable attention. Some protection has been afforded to metals by coating them with organic films such as paints or enamels. Although these coatings are relatively resistant to chemical attacks, they are subject to degradation at high temperatures and exhibit poor adhesion to metallic substrates, particularly when temperature cycling is involved.

Numerous other methods of coating metals and their alloys with a protective inorganic surface have been proposed and disclosed in several patents. For example, it is well-known to provide aluminum with a protective coating by an electrolytic process involving anodization of the metal. However, the anodized surface of aluminum obtained by this process does not withstand attack by various acids or even weak alkalis.

U.S. Pat. No. 1,923,539 discloses the formation of protective coatings on magnesium, aluminum and their alloys by an electrolytic process in various solutions, use being made of alternating current at about 100 volts. The coatings produced, however, are not sufficiently resistant to attack by corrosive agents such as strong acids and strong alkalis. Additionally, they lack the hardness and durability required in numerous applications.

Czechoslovakian Pat. No. 104,927 issued to Hradcovsky et al. discloses electrolytic coating of aluminum in which the electrolyte is an aqueous solution comprising sodium or potassium silicate and a hardener such as ammonium molybdate. The resulting silicate coating is highly porous and exhibits a weak breakdown voltage.

U.S. Pat. No. 3,832,293 issued to Hradcovsky et al. discloses a process for providing a durable coating on so-called "rectifier" metals such a aluminum and magnesium by an electrolytic process which comprises immersing the metal in an aqueous bath comprising an alkali metal silicate, an alkali metal hydroxide and an oxyacid catalyst, and imposing a potential difference of at least 220 volts between the metal and the bath to deposit a silicate coating on the immersed surface of the metal.

A more recent U.S. Pat. No. 3,834,999 to Hardcovsky et al. discloses another process for electrolytic coating of rectifier metals, comprising immersing the metal in a strongly alkaline bath containing an alkali metal hydroxide and at least one anion such as tungstate, phosphate, arsenate, stannate, stibnate, molybdate borate, chromate and dichromates, alone or in combination, and carbonate, in combination only. The process involves coagulation of colloids at the surface of the metal to produce glassy, adherent and corrosion-resistant coating.

Although the various methods described in the above-identified United States patents produce coatings which are superior to the porous coatings made by the method disclosed in the Czechoslovakian patent, the methods themselves suffer from one or more deficiencies. For example, substantial electrical potential is usually required to discharge visible spark at the metal surface and a relatively long period of time is frequently necessary to build up a uniform film of suitable thickness. Additionally, some of the electrolytes, particularly those containing sodium silicate, are unstable, with resulting precipitation and change in the electrolyte concentration. Consequently, the bath may not be reused over any substantial period of time.

The ionic conductivities of the coatings produced on magnesium and its alloys by the prior art processes do not usually satisfy the anti-corrosive standards required for these metals. Additionally, relatively long period of time (30 to 60 minutes) is usually required to form a satisfactory coating.

Thus, there is still a need for an effective process for coating magnesium and its alloys with a hard uniform, smooth, adherent and corrosion-resistant coating which can withstand attack by strong acids and strong alkalis.

SUMMARY OF INVENTION

Accordingly, it is the main object of this invention to provide magnesium and its alloys with a hard, durable, uniform, adherent and corrosion-resistant coating, with a high voltage breakdown.

It is a further object of this invention to provide magnesium and its alloys with such a coating at relatively low electrical potential and in relatively short period of time.

It is a further object of this invention to provide an improved method of coating magnesium and its alloys with a hard, durable, uniform, adherent and corrosion-resistant coating.

Briefly stated, a process in accordance with the invention comprises pretreatment of magnesium metal, or its alloys, with an aqueous solution of hydrofluoric acid (HF) to form an insoluble fluoromagnesium film on the surface of the metal, followed by immersing the coated metal in a metallic container comprising an electrolytic bath which comprises an aqueous solution of alkali metal silicate and an aqueous solution of alkali metal hydroxide. An electrical potential is then applied between the magnesium metal anode and the container or cathode until a visible spark is discharged across the surface of the metal. This potential is maintained for a few minues until a coating of the desired thickness is formed on the fluoromagnesium layer.

The magnesium and magnesium alloys coated products obtained in accordance with this invention exhibit greater resistance to strong acids and strong alkali compared to magnesium and its alloys which have been coated by the prior art methods.

DETAILED DESCRIPTION OF INVENTION

In a method in accordance with the invention to provide magnesium or its alloys with a hard, durable, uniform, adherent and corrosion-resistant coating, the metal is first pickled by placing it in an aqueous solution of hydrofluoric acid at a solution temperature of from about 5° to about 30° C., and preferably from about 20° to about 25° C. The acid concentration may vary widely. Generally, while any concentration may be used with efficacious results, it is preferable to employ an aqueous solution of hydrofluoric acid in which the acid concentration ranges from about 5 to about 10 weight percent.

After a period of from about 3 to about 10 minutes, the metal is removed from the acid bath and rinsed several times with water to wash the acid away from the metal surface.

Treatment of the metal with an aqueous solution of hydrofluoric acid in the above manner results in the formation of a uniform, adherent fluoromagnesium coating on the metal surface which prevents ionic conductivity on the magnesium surface. Ionic conductivity at the metal surface is undesirable because it adversely affects the rectifying property of the metal in alkaline solution. The fluoromagnesium coating on the surface of the metal considerably enhances the rectifying quality of the metal when coated electrolytically in a strongly alkaline electrolyte.

The magnesium metal which has been pickled and cleaned is thereafter placed in a metallic container containing an electrolytic bath to be hereinafter defined. An electrical potential of from about 150 to about 350 volts is then applied between the magnesium metal, which serves as the anode, and the container, which serves as the cathode, until a visible spark is discharged across the surface of the metal. This voltage level is maintained by continuous passage of direct electrical current at a current density of from about 50 to about 200 milliamperes per square centimeter for about 1 to about 5 minutes until the desired coating thickness is obtained. The temperature of the electrolytic bath may be varied from about 5° to about 70° C., preferably from about 20° C. to about 50° C.

The electrolytic bath is an aqueous solution of an alkali metal silicate alone or in admixture with an aqueous solution of an alkali metal hydroxide. The alkali metal in each case may be sodium, potassium, lithium or mixtures thereof. Thus, potassium silicate, sodium silicate and/or lithium silicate may be employed as the silicate component of the bath and potassium hydroxide, sodium hydroxide and/or lithium hydroxide are the hydroxides of choice in the practice of this invention.

Other salts may be used with the alkali metal silicates, if desired. These salts, which must be stable in the silicate solution, include alkali metal molybdenate and alkali metal tungstenate. However, use of alkali metal silicate alone constitutes the preferred practice during the electrolytic coating step of the process of this invention.

When one of the above-noted salts is used in lieu of silicate, the alkali metal component of the salt is sodium, potassium, lithium or mixtures thereof, as in the case of using alkali metal silicate.

The relative amounts of the electrolytic bath components may be varied over a wide range with substantially the same efficacious results. Thus the weight ratio of the metal silicate (or other salts) to the metal hydroxide in the bath can vary from about 1 to about 10, and preferably from about 4 to about 6, provided, however, that the maximum concentration of the metal silicate (or other salts) does not exceed about 30 percent.

When the magnesium metal, or its alloys, which has been pickled in the manner described above, is treated in the electrolytic bath, and a visible spark is discharged, it is believed that the heat generated at the surface of the metal will melt the fluoromagnesium coating on the metal surface while a silicate coating is simultaneously deposited thereon, thereby producing a fluoromagnesium-silicate coating.

After the electrolytic reaction has been completed (within 1-3 minutes), the metal is removed from the electrolytic bath and rinsed with water several times until the electrolytic solution is completely washed away from the metal surface, and thereafter dried.

The thickness of the fluoromagnesium layer is usually only about a few microns, and practically about 2 to about 3 microns to prevent ionic conductivity of the metal. The thickness of the silicate layer, however, may vary from about 0.50 to about 0.05 mm, and is preferably from about 0.1 to about 0.2 mm.

The silicate coating which is thus obtained is hard, smooth, durable, adherent and corrosion-resistant, and withstands the action of strong acids and alkalis.

If it is desired to further increase the thickness of the coating on the metal surface, the coated metal can be subjected to a second electrolytic operation as hereinbefore described but wherein the electrolytic bath does not include the metal hydroxide solution. This additional electrolytic step affords further increase in the thickness of the coating on the metal surface.

The following are examples of suitable electrolytic baths which can be employed in the practice of this invention following pretreatment (pickling) of the metal. These examples, however, are illustrative and are not intended to limit the electrolytes to those mentioned herein. Other electrolytes and varying concentrations may be used in accordance with this invention:

| Example I | Grams |
|---|---|
| $K_2SiO_3$ | 20 |
| KOH (granular) | 50 |
| $H_2O$ | 1000 |
| Example II | |
| $K_2SiO_3$ | 10 |
| KOH (granular) | 40 |
| $H_2O$ | 1000 |
| Example III | |
| $K_2SiO_3$ | 30 |
| KOH (granular) | 30 |
| $H_2O$ | 1000 |
| Example IV | |
| $K_2SiO_3$ | 30 |
| KOH | 40 |
| $H_2O$ | 1000 |
| Example V | |
| $Na_2SiO_3$ | 20 |
| KOH (granular) | 15 |
| $H_2O$ | 1000 |
| Example VI | |
| $Na_2SiO_3$ | 5 |
| KOH (granular) | 30 |
| $H_2O$ | 1000 |
| Example VII | |
| $Na_2SiO_3$ | 30 |
| KOH (granular) | 30 |
| $H_2O$ | 1000 |
| Example VIII | |
| $Na_2SiO_3$ | 50 |
| NaOH | 50 |
| $H_2O$ | 1000 |
| Example IX | |
| $Na_2SiO_3$ | 30 |
| NaOH | 52 |
| $H_2O$ | 1000 |

These alkaline electrolytes yield a hard, uniform, adherent and corrosion-resistant protective coating on the metal and exhibit high voltage breakdown. The coatings are generally milky white in color. However, if variations in the color of these coatings are desired, the coated metal can be further treated with a bath comprising aqueous solutions of potassium silicate and potassium vanadate. Various shades of colors, between white and black, can be obtained by varying the relative amounts of potassium silicate and potassium vanadate.

The following are suitable solutions for obtaining black coatings on the metal surfaces. Once again, these solutions are merely illustrative and do not necessarily limit the components or their concentrations to those mentioned herein.

| Example X | Grams |
|---|---|
| $K_2SiO_3$ | 10 |
| potassium vanadate | 10 |
| $H_2O$ | 1000 |
| Example XI | |
| $K_2SiO_3$ | 50 |
| potassium vanadate | 5 |
| $H_2O$ | 1000 |
| Example XII | |
| $K_2SiO_3$ | 100 |
| potassium vanadate | 15 |
| $H_2O$ | 1000 |

Magnesium metals coated by the method of this invention were tested by the so-called "drop method" wherein several drops of hydrochloric acid and sulfuric acid were applied to the surface of the metal. After the drops had dried, no visible changes were detectable on the metal surface.

Similar tests with an acidified aqueous solution containing 1% $SnCl_2$ and 1% HCl, and with an acidified aqueous solution containing 1% $CuCl_2$ and 1% HCl gave no visible or detectable change on the surface of the metal.

While there have been shown and described preferred embodiments of an anti-corrosive coating on magnesium and its alloys in accordance with the invention, many changes and modifications may be made therein without, however, departing from the essential spirit thereof.

I claim:

1. A method of coating a metal selected from the group consisting of magnesium and magnesium alloy with a hard, uniform, adherent layer having improved resistance to strong acids and strong alkalis, which process comprises:

(a) contacting said metal with an aqueous solution of hydrofluoric acid at a temperature of from about 5° C. to about 30° C. to form a fluoromagnesium layer on said metal;

(b) washing said metal with water to rinse away the hydrofluoric acid;

(c) immersing the cleaned, coated metal from step (c) in a metallic container containing an electrolyte bath made from an aqueous solution of an alkali metal silicate; and (d) applying an electrical potential of from about 150 volts to about 350 volts between said metal and said metallic container until a visible spark is discharged across the surface of said metal, said voltage being maintained until the desired coating thickness is formed on said metal.

2. A method as in claim 1, wherein said electrolytic bath is an aqueous solution of an alkali metal silicate and an alkali metal hydroxide.

3. A method as in claim 2, wherein said alkali metal silicate is selected from the group consisting of sodium silicate, potassium silicate, lithium silicate and mixtures thereof, and said alkali metal hydroxide is selected from the group consisting of sodium hydroxide, potassium hydroxide, lithium hydroxide and mixtures thereof.

4. A method as in claim 3, wherein said metal is magnesium.

5. A method as in claim 4, wherein in step (c) said coated metal is immersed in a non-conductive vessel containing said electrolytic bath and a metal cathode, and said voltage potential is applied across said coated metal and said metal cathode.

6. A method as in claim 5, wherein said electrolytic bath is maintained at a temperature of from about 5° C. to about 70° C.

7. A method as in claim 4, wherein said electrolytic bath is maintained at a temperature of from about 5° C. to about 70° C.

8. A method as in claim 3, wherein in step (c) said coated metal is immersed in a non-conductive vessel containing said electrolytic bath and a metal cathode, and said voltage potential is applied across said coated metal and said metal cathode.

9. A method as in claim 8, wherein said electrolytic bath is maintained at a temperature of from about 5° C. to about 70° C.

10. A method as in claim 3, wherein said electrolytic bath is maintained at a temperature of from about 5° C. to about 70° C.

11. A method as in claim 2, wherein said metal is magnesium.

12. A method as in claim 11, wherein in step (c) said coated metal is immersed in a non-conductive vessel containing said electrolytic bath and a metal cathode, and said voltage potential is applied across said coated metal and said metal cathode.

13. A method as in claim 12, wherein said electrolytic bath is maintained at a temperature of from about 5° C. to about 70° C.

14. A method as in claim 11, wherein said electrolytic bath is maintained at a temperature of from about 5° C. to about 70° C.

15. A method as in claim 2, wherein in step (c) said coated metal is immersed in a non-conductive vessel containing said electrolytic bath and a metal cathode, and said voltage potential is applied across said coated metal and said metal cathode.

16. A method as in claim 15, wherein said electrolytic bath is maintained at a temperature of from about 5° C. to about 70° C.

17. A method as in claim 2, wherein said electrolytic bath is maintained at a temperature of from about 5° C. to about 70° C.

18. A method as in claim 1, wherein said alkali metal silicate is selected from the group consisting of sodium silicate, potassium silicate, lithium silicate and mixtures thereof.

19. A method as in claim 18 wherein said metal is magnesium.

20. A method as in claim 19, wherein in step (c) said coated metal is immersed in a non-conductive vessel containing said electrolytic bath and a metal cathode, and said voltage potential is applied across said coated metal and said metal cathode.

21. A method as in claim 20, wherein said electrolytic bath is maintained at a temperature of from about 5° C. to about 70° C.

22. A method as in claim 19, wherein said electrolytic bath is maintained at a temperature of from about 5° C. to about 70° C.

23. A method as in claim 18, wherein in step (c) said coated metal is immersed in a non-conductive vessel containing said electrolytic bath and a metal cathode, and said voltage potential is applied across said coated metal and said metal cathode.

24. A method as in claim 23, wherein said electrolytic bath is maintained at a temperature of from about 5° C. to about 70° C.

25. A method as in claim 18, wherein said electrolytic bath is maintained at a temperature of from about 5° C. to about 70° C.

26. A method as in claim 1, wherein said metal is magnesium.

27. A method as in claim 26, wherein in step (c) said coated metal is immersed in a non-conductive vessel containing said electrolytic bath and a metal cathode, and said voltage potential is applied across said coated metal and said metal cathode.

28. A method as in claim 27, wherein said electrolytic bath is maintained at a temperature of from about 5° C.to about 70° C.

29. A method as in claim 26, wherein said electrolytic bath is maintained at a temperature of from about 5° C. to about 70° C.

30. A method as in claim 1, wherein in step (c), said coated metal is immersed in a non-conductive vessel containing said electrolytic bath and a metal cathode, and said voltage potential is applied across said coated metal and said metal cathode.

31. A method as in claim 30, wherein said electrolytic bath is maintained at a temperature of from about 5° C. to about 70° C.

32. A method as in claim 1, wherein said electrolytic bath is maintained at a temperature of from about 5° C. to about 70° C.

* * * * *